US009938103B1

(12) United States Patent
Merminod

(10) Patent No.: US 9,938,103 B1
(45) Date of Patent: Apr. 10, 2018

(54) VINYL ROLL DISPENSING AND STORAGE APPARATUS

(71) Applicant: Jean-Phillippe Merminod, Tampa, FL (US)

(72) Inventor: Jean-Phillippe Merminod, Tampa, FL (US)

( * ) Notice: Subject to any disclaimer, the term of this patent is extended or adjusted under 35 U.S.C. 154(b) by 276 days.

(21) Appl. No.: 15/002,316

(22) Filed: Jan. 20, 2016

(51) Int. Cl.
*B65H 16/02* (2006.01)
*B65H 16/00* (2006.01)
*B65H 16/06* (2006.01)

(52) U.S. Cl.
CPC ..... *B65H 16/021* (2013.01); *B65H 16/005* (2013.01); *B65H 16/023* (2013.01); *B65H 16/06* (2013.01)

(58) Field of Classification Search
CPC ... B65H 16/005; B65H 16/021; B65H 16/023
USPC ..... 242/403, 557, 596.8, 594.2–594.3, 578, 242/578.2
See application file for complete search history.

(56) References Cited

U.S. PATENT DOCUMENTS 548,987 A * 10/1895 Heyman ..... A47K 10/38 242/594
908,313 A * 12/1908 Nelson ..... B65H 35/0006 225/38
4,844,360 A * 7/1989 Winter ..... B65H 16/021 211/171
5,011,059 A * 4/1991 Jennings, Jr. ..... B65H 16/021 225/35
2002/0038838 A1* 4/2002 Marois ..... B65H 16/06 242/596.6
2006/0266875 A1* 11/2006 Chou ..... A47K 10/3836 242/597.7
2016/0340070 A1* 11/2016 Yu Chen ..... B65B 67/08
2016/0355373 A1* 12/2016 Yu Chen ..... B65H 16/005

FOREIGN PATENT DOCUMENTS

GB 2464474 A * 4/2010 ..... B62B 3/104
JP 58177843 A * 10/1983
WO WO-2016078774 A1 * 5/2016 ..... B65H 23/063

* cited by examiner

*Primary Examiner* — William E Dondero
(74) *Attorney, Agent, or Firm* — Gulf Coast Intellectual Property Group

(57) ABSTRACT

A vinyl roll storage and dispensing apparatus that is operable to receive and store a plurality of vinyl rolls wherein at least two of the vinyl rolls are oriented in axial alignment and vertically stacked. The vinyl roll storage and dispensing apparatus further includes a base platform having a first support member and a second support member being planar in manner wherein the second support member is superposed the first support member and rotatably mounted thereto. A central post member is mounted to the second support member and extends upwards therefrom. A plurality of channels are formed within the central post member. At least two vinyl roll engagement members are present and are operable to receive and retain a vinyl rolls therein. The vinyl roll engagement members are configured to stack at least two vinyl rolls in a vertical orientation.

20 Claims, 4 Drawing Sheets

VINYL ROLL DISPENSING AND STORAGE APPARATUS

FIELD OF THE INVENTION

The present invention relates generally to rolled material storage apparatus, more specifically but not by limitation a vinyl storage and dispensing apparatus that is operable to receive and store a plurality of vinyl rolls wherein the apparatus is configured to store vinyl rolls in a superposed configuration.

BACKGROUND

Vinyl is a common material that is utilized in a variety of different products. As is known in the art one embodiment of vinyl is the vinyl roll. Vinyl rolls are produced in a variety of sizes and colors and are utilized in various industries such as but not limited to sign production. In the sign production industry it is common to utilize large vinyl rolls wherein the most common configuration for the vinyl rolls is to have the vinyl rolls mounted in a horizontal manner on a rack or similar structure that is mounted to a wall. Users simply unroll the amount of vinyl needed for a particular task and cut the desired vinyl away from the roll.

One problem with conventional storage of vinyl rolls is the amount of room that is required to store the rolls of vinyl. As mentioned, many conventional techniques of storing vinyl rolls involve cumbersome and large structures that are typically secured to or placed adjacent to a wall. The aforementioned structures are typically not mobile and as such can not be moved proximate to a desired area where it may be more convenient to have the vinyl rolls located. Other types of storage apparatus exist for vinyl rolls exist that are mobile but have proven limited in their usefulness. Current mobile vinyl roll storage apparatus do not allow a stacking configuration wherein at least two rolls can be stacked in vertical alignment on the storage apparatus. Additionally, existing devices are not configured to provide a user improved access and selection of a vinyl roll stored thereon.

Accordingly, there is a need for a vinyl roll storage and dispensing apparatus that is configured to be mobile and further configured to provide vertical mounting of at least two vinyl rolls wherein the vinyl rolls are in axial alignment.

SUMMARY OF THE INVENTION

It is the object of the present invention to provide a vinyl roll storage and dispensing apparatus that is operable to receive and store a plurality of vinyl rolls wherein the vinyl rolls can be superposed each other in an axial orientation.

Another object of the present invention is to provide a vinyl roll storage and dispensing apparatus that includes a base platform wherein the base platform has a plurality of wheels mounted thereto.

A further object of the present invention is to provide a vinyl roll storage and dispensing apparatus that is configured to store a plurality of vinyl rolls wherein the base platform includes a first support member and a second support member wherein the second support member superposed and rotatable with respect to the first support member.

Still another object of the present invention is to provide a vinyl roll storage and dispensing apparatus that includes a central post support member wherein the central post support member extends upward from the base platform.

An additional object of the present invention is to provide a vinyl roll storage and dispensing apparatus that is configured to facilitate storage of vinyl rolls in a vertically stacked orientation wherein the central post support member includes a plurality of channels extending the length thereof.

Yet a further object of the present invention is to provide a vinyl roll storage and dispensing apparatus that is configured to receive and store vinyl rolls wherein vinyl rolls of varying widths can be secured adjacent to the central post member in a stacked configuration.

Another object of the present invention is to provide a vinyl roll storage and dispensing apparatus that includes a plurality of vinyl roll engagement members that are slidably secured within the plurality of channels of the central post support member.

An alternate object of the present invention is to provide a vinyl roll storage and dispensing apparatus that is configured to facilitate the storage of vinyl rolls wherein the vinyl rolls can be secured in a stacked configuration and wherein the vinyl roll engagement members include a support arm.

Still a further object of the present invention is to provide a mobile vinyl roll storage and dispensing apparatus that is configured to receive and store vinyl rolls in a vertically stacked orientation wherein the support arm includes a upper mounting disc and a lower mounting disc secured thereto distal to the central post member.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
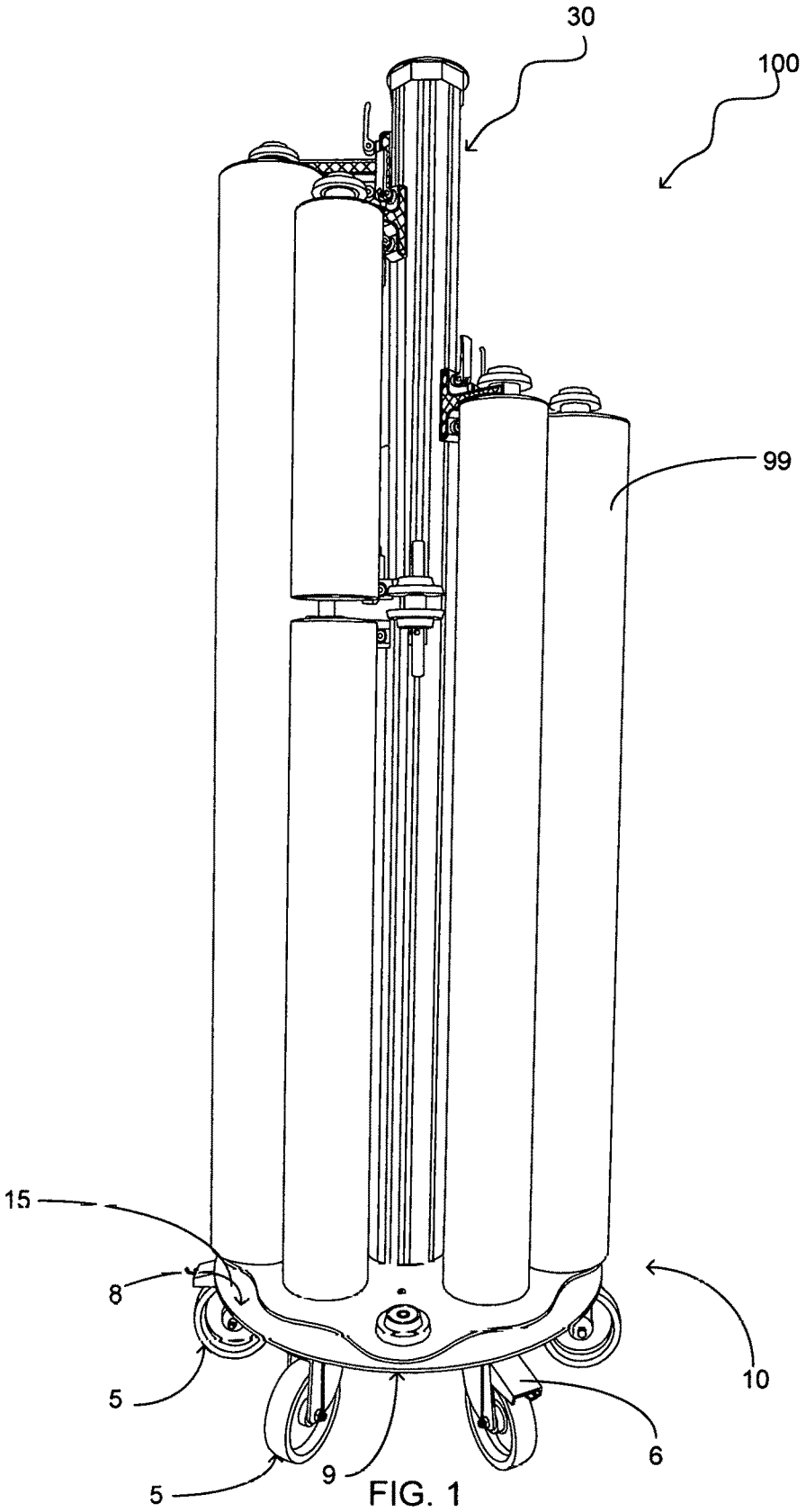
FIG. 1 is a perspective view of the present invention having a plurality of vinyl rolls secured thereto.

Referring now to the drawings submitted herewith, wherein various elements depicted therein are not necessarily drawn to scale and wherein through the views and figures like elements are referenced with identical reference numerals, there is illustrated a vinyl storage and dispensing apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Figure 2:
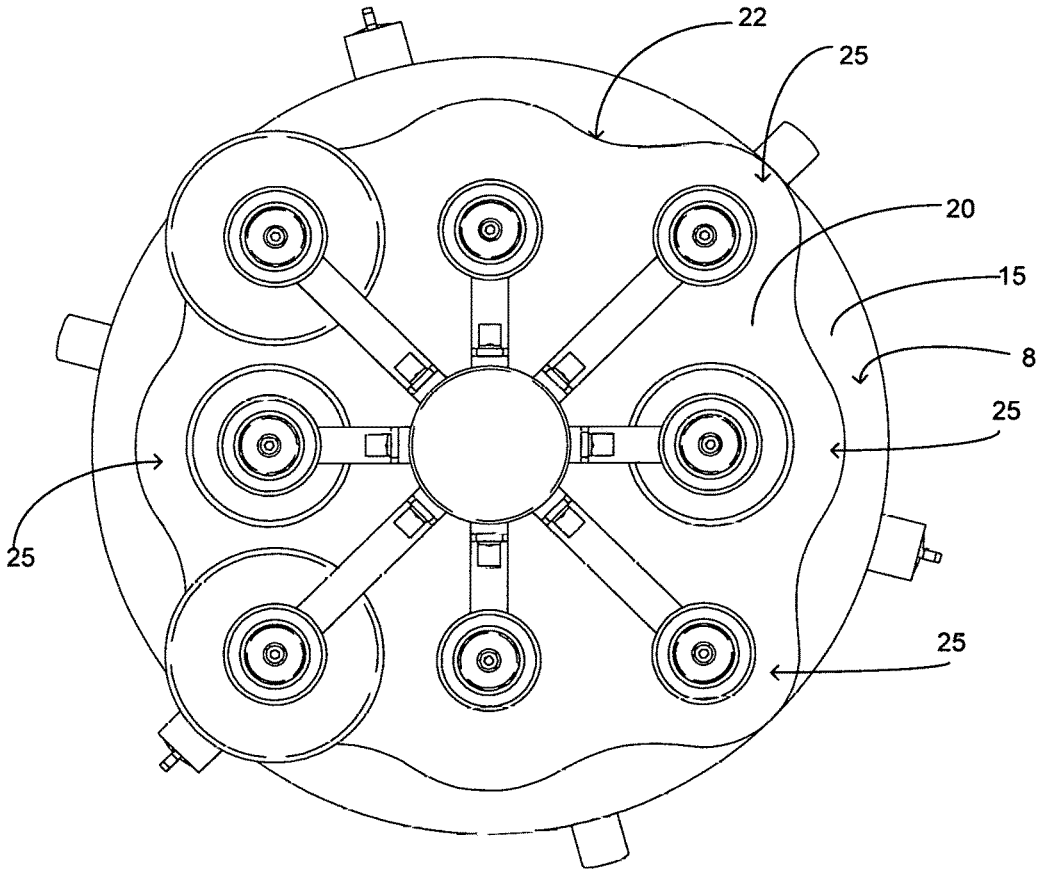
FIG. 2 is a top view of the present invention.
Figure 3:
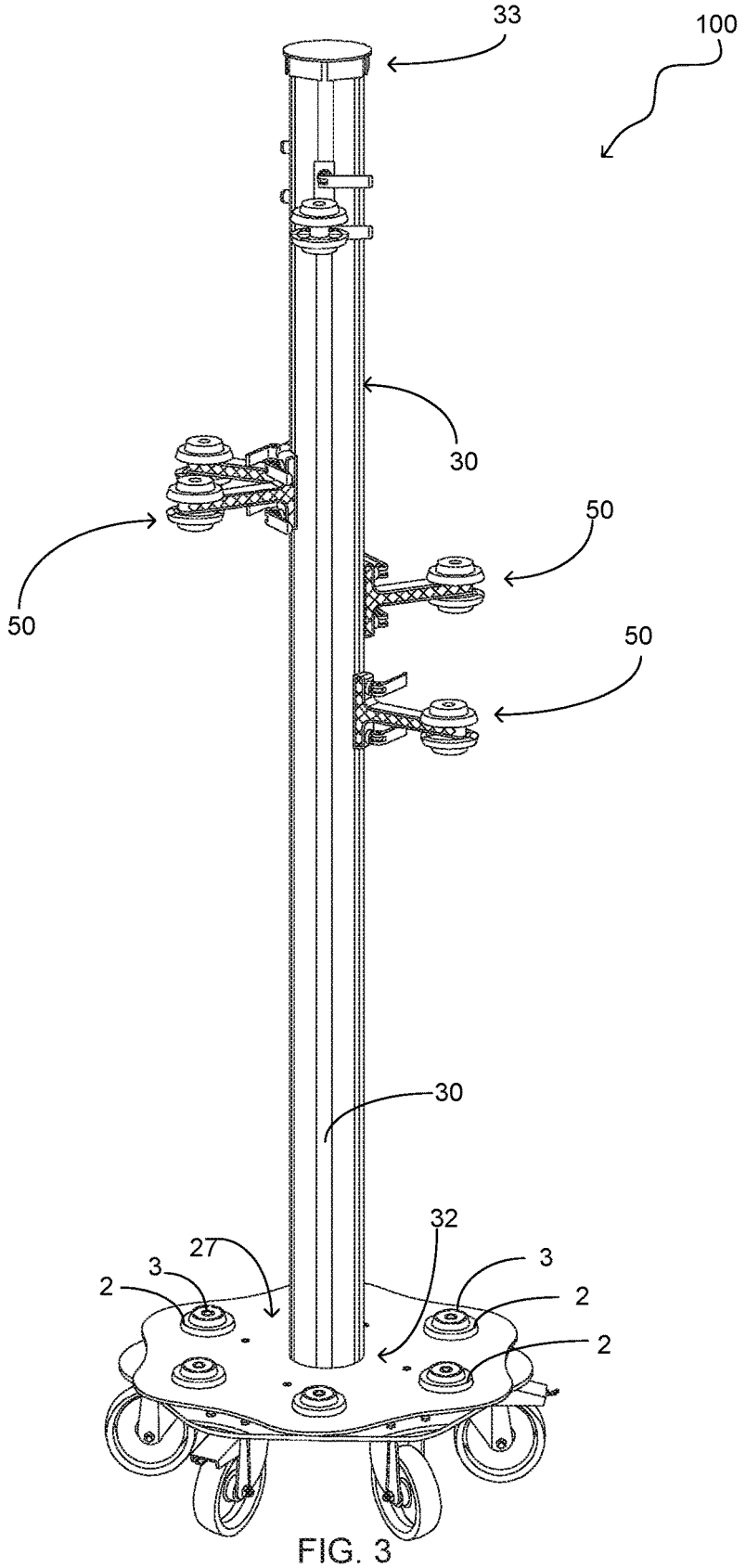
FIG. 3 is a perspective view of the present invention.
Figure 4:
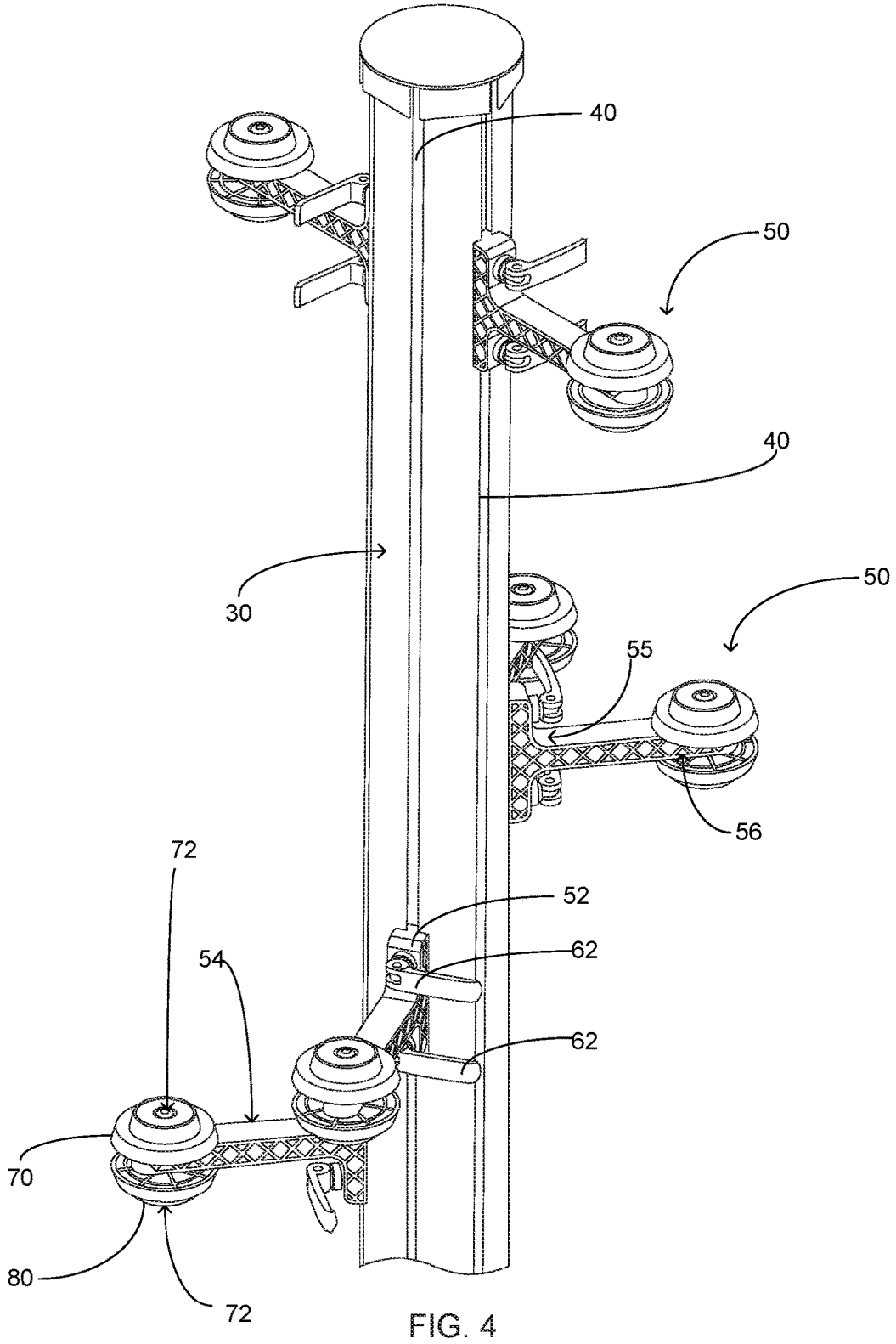
FIG. 4 detailed view of a section of the central post support member of the present invention having vinyl roll engagement members secured thereto.

Referring in particular to FIGS. 1 and 2 herein, the vinyl storage and dispensing apparatus 100 includes base platform 10 that is manufactured from a suitable durable material such as but not limited to metal. The base platform 10 includes a bottom surface 9 to which a plurality of wheels 5 are secured. The wheels 5 are conventional wheels having brake levers 6 and are operable to allow a user to move the vinyl storage and dispensing apparatus 100 to a desired location. Brake levers 6 are operable to bias against the wheel 5 and inhibit the rotation thereof. It is contemplated within the scope of the present invention that the base platform 10 could have secured thereto numerous different quantities of wheels 5 and achieve the desired functionality as described herein. Furthermore, it should be recognized that the base platform 10 could be secured to alternate elements in order to achieve the desired functionality of being able to move the vinyl storage and dispensing apparatus 100 to a desired location.

The base platform 10 includes a first support member 15 and a second support member 20. The first support member 15 is planar in manner and annular in shape being manufactured from a suitable durable material such as but not limited to metal. The first support member 15 has an upper surface 8 and a bottom surface 9. The wheels 5 are secured utilizing suitable techniques to the bottom surface 9 of the first support member 15. While the first support member 15 is illustrated herein as being annular in shape, it is contemplated within the scope of the present invention that the first support member 15 could be formed in alternate shapes and sizes. Rotatably mounted to the first support member 15 and superposed thereto is the second support member 20. The second support member 20 is planar in manner and is manufactured from a suitable durable material such as but not limited to metal. The second support member 20 is rotatably mounted to the first support member 15 utilizing suitable fasteners that facilitate the rotation of the second support member 20 with respect to the first support member 20. It is contemplated within the scope of the present invention that numerous types of fasteners could be utilized to rotatably mount the second support member 20 to the first support member 15. The second support member 20 has a perimeter edge 22 that is undulated in form. The undulated form of the perimeter edge 22 creates projection areas 25 that provide an improved shape to accommodate a roll of material such as but not limited to an exemplary vinyl roll 99. The undulated form of the perimeter edge 22 provides a plurality of projection areas 25 which facilitate the accommodation of an increase quantity of exemplary vinyl rolls 99 and further provides improved access thereto. While in the preferred embodiment illustrated herein, the perimeter edge 22 of the second support member is illustrated and described as being undulated in form, it is contemplated within the scope of the present invention that the perimeter edge 22 of the second support member 20 could be formed in alternate shapes and/or patterns in order to achieve the desired objective herein. Secured to the upper surface 27 of the second support member 20 are a plurality of roll mounts 2. Roll mounts 2 are secured to the upper surface 27 utilizing suitable durable techniques and are secured in the projection areas 25 and are operable to have an exemplary vinyl roll 99 superposed thereon. The roll mounts 2 are half-domed shaped having a flat top surface 3. It is contemplated within the scope of the present invention that the roll mounts 2 could be formed in numerous different shapes and sizes in order to achieve the desired functionality herein.

A central post member 30 is secured to the upper surface 27 of the second support member 20. The central post member 30 is secured to the second support member 20 utilizing suitable durable techniques and is secured in the center thereof. The central post member 30 is manufactured from a suitable material such as but not limited to metal and functions to provide the structural support for the plurality of exemplary vinyl rolls 99 that are mounted to the vinyl storage and dispensing apparatus 100. The central post member 30 includes first end 32 proximate second support member 20 and second end 33 distal thereto. It is contemplated within the scope of the present invention that the central post member 30 could be provided in various different heights in order to accommodate exemplary vinyl rolls 99 of different sizes. The central post member 30 has a plurality of channels 40 formed therein. The channels 40 are formed in the central post member 30 utilizing suitable techniques and extend intermediate the first end 32 and second end 33. It is contemplated within the scope of the present invention that the central post member 30 could have as few as one channel 40 formed therein or have a plurality of channels 40 formed therein.

Slidably secured within the channels 40 are the vinyl roll engagement members 50. The vinyl roll engagement members 50 are operable to receive and support an exemplary vinyl roll 99. The vinyl roll engagement members 50 include base 52 that is configured to be captively and slidably mounted within channel 40. It is contemplated within the scope of the present invention that the base 52 could be formed in numerous manners so as to captively and slidably secure the vinyl roll engagement members 50 within the channel 40. Extending outward from the base 52 and being perpendicular thereto is support arm 54. The support arm 54 is integrally formed with the base 52 utilizing suitable techniques. Support arm 54 includes first end 55 and second end 56. Support arm 54 is manufactured having a sufficient length so as to place the upper mounting disc 70 and lower mounting disc 80 in axial alignment with roll mounts 2. The base 52 further has operably coupled thereto keeper 62. The keeper 62 is operable to maintain the position of the vinyl roll engagement member 50 ensuing its desired placement along the channel 40. It is contemplated within the scope of the present invention that the keepers 62 could be formed utilizing various types of mechanical fasteners that are operable to have the ability to tighten and loosen the base 52 within the channel 40. It is further contemplated within the scope of the present invention that the base 52 could have as few as one keeper 62 secured thereto or more than one keeper 62.

Rotatably secured to the support arm 54 proximate second end 56 is the upper mounting disc 70 and lower mounting disc 80. The upper mounting disc 70 and lower mounting disc 80 are rotatably secured utilizing suitable techniques and are operable to receive and provide support for an exemplary vinyl roll 99. The upper mounting disc 70 and lower mounting disc 80 are generally half-domed shaped having a flat upper surface 72 and are manufactured from a suitable durable material such as but not limited to plastic. It is contemplated within the scope of the present invention that the upper mounting disc 70 and lower mounting disc 80 could be formed in various shapes in order to mateably receive an end of an exemplary vinyl roll 99 and allow the rotation thereof while engaged therewith. Having a vinyl roll engagement member 50 with an upper mounting disc 70 and lower mounting disc 80 facilitates the ability for a user to stack at least two exemplary vinyl rolls 99 in axial alignment as shown in particular herein in FIG. 1. The aforementioned configuration of the vinyl roll engagement member 50 allows a user to load a single channel with two exemplary vinyl rolls 99 having different widths so as to maximize the utilization of the space provided by the height of the central post member 30. While two exemplary vinyl rolls 99 are illustrated herein in FIG. 1 in a vertically stacked orientation, it is contemplated within the scope of the present invention that more than two exemplary vinyl rolls 99 could be vertically stacked depending on the height of the central post member 30 provided.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A vinyl storage and dispensing apparatus comprising:

a base platform, said base platform including a first support member and a second support member, said second support member being superposed said first support member, said second support member including an upper surface, said base platform configured to be movable, said second support member being rotatably mounted to said first support member;

a central post member, said central post member being mounted to said second support member and extending upward therefrom, said central post member being mounted in the center of said second support member, said second support member being planar in manner;

at least one channel, said at least one channel being formed in said central post member and extending the length thereof;

at least two vinyl roll engagement members, said at least two vinyl roll engagement members being slidably mounted within said at least one channel; and wherein said at least two vinyl roll engagement members are operable to receive and store a first vinyl roll and a second vinyl roll wherein the first vinyl roll and the second vinyl roll are oriented in a vertically stacked orientation such that the first vinyl roll and second vinyl roll are in axial alignment.

2. The vinyl storage and dispensing apparatus as recited in claim 1, and further including at least one vinyl roll mount, said at least one vinyl roll mount being secured to said upper surface of said second support member.

3. The vinyl storage and dispensing apparatus as recited in claim 2, wherein said at least two vinyl roll engagement members include a base, said base being configured so as to be captively and slidably secured within said at least one channel.

4. The vinyl storage and dispensing apparatus as recited in claim 3, wherein said vinyl roll engagement member includes an upper mounting disc and a lower mounting disc.

5. The vinyl storage and dispensing apparatus as recited in claim 4, wherein said second support member of said base platform is rotatable with respect to said first support member of said base platform.

6. The vinyl storage and dispensing apparatus as recited in claim 5, and further including at least one keeper, said at least one keeper being mounted to at least two vinyl roll engagement members, said at least one keeper operable to maintain position of said at least two vinyl roll engagement members within said channel.

7. The vinyl storage and dispensing apparatus as recited in claim 6, wherein said base platform is mounted on a plurality of wheels.

8. A vinyl roll storage and dispensing apparatus that is configured to be easily moved comprising:

a base platform, said base platform including a first support member and a second support member, said first support member being planar in manner, said second support member being planar in manner, said second support member being superposed said first support member, said second support member including an upper surface, said base platform configured to be movable, said second support member being rotatably mounted to said first support member;

a plurality of roll mounts, said plurality of roll mounts being secured to the upper surface of said second support member;

a central post member, said central post member being mounted to said second support member and extending upward therefrom, said central post member being mounted in the center of said second support member, said central post member having a first end and a second end;

a plurality of channels, said plurality of channels being formed in said central post member and extending intermediate said first end and said second end;

a plurality of vinyl roll engagement members, said plurality of vinyl roll engagement members being slidably mounted within said plurality of channels; and wherein said two of said plurality of vinyl roll engagement members are disposed within a same channel and are operable to receive and store a first vinyl roll and a second vinyl roll wherein the first vinyl roll and the second vinyl roll are oriented in a vertically stacked orientation such that the first vinyl roll and second vinyl roll are in axial alignment.

9. The vinyl roll storage and dispensing apparatus as recited in claim 8, wherein said second support member of said base platform is rotatably mounted to said first support member of said base platform.

10. The vinyl roll storage and dispensing apparatus as recited in claim 9, wherein said second support member further includes a perimeter edge, said perimeter edge being undulated in form.

11. The vinyl roll storage and dispensing apparatus as recited in claim 10, wherein said plurality of vinyl roll engagement members further include a base and a support arm, said base and support arm being integrally formed, said support arm having an upper mounting disc and a lower mounting disc secured thereto distal to said central post member.

12. The vinyl roll storage and dispensing apparatus as recited in claim 11, wherein at least one of said plurality of roll mounts and at least two of said plurality of vinyl roll engagement members are in axial alignment.

13. The vinyl roll storage and dispensing apparatus as recited in claim 12, wherein said plurality of vinyl roll engagement members further include at least one keeper, said at least one keeper operable to maintain a position of the vinyl roll engagement members within said plurality of channels.

14. The vinyl roll storage and dispensing apparatus as recited in claim 13, wherein the perimeter edge having an undulated form of the second support member is operable to form projection areas in which the plurality of roll mounts are secured.

15. A vinyl roll storage and dispensing apparatus that is operable to receive and store a plurality of vinyl rolls wherein at least two of the vinyl rolls are oriented in a vertically stacked configuration comprising:

a base platform, said base platform including a first support member and a second support member, said first support member being planar in manner having an upper surface and a lower surface, said second support member being planar in manner, said second support member being superposed said first support member, said second support member including an upper surface, said first support member of said base platform having a plurality of wheels secured to the lower surface thereof, said second support member being rotatably mounted to said first support member;

a plurality of roll mounts, said plurality of roll mounts being secured to the upper surface of said second support member, said plurality of roll mounts being half-domed in shape, said plurality of roll mounts having a flat upper surface;

a central post member, said central post member being mounted to said second support member and extending upward therefrom, said central post member being mounted in the center of said second support member, said central post member having a first end and a second end, said first end of said central post member being proximate said upper surface of said second support member;

a plurality of channels, said plurality of channels being formed in said central post member and extending intermediate said first end and said second end;

a plurality of vinyl roll engagement members, said plurality of vinyl roll engagement members being slidably mounted within said plurality of channels, said plurality of vinyl roll engagement members further including a base, said base being captively and slidably secured within said plurality of channels, said plurality of vinyl roll engagement members further including a support arm, said support arm extending outward from said base, said plurality of vinyl roll engagement members configured to receive and support a vinyl roll above and below with respect thereto; and wherein said two of said plurality of vinyl roll engagement members are disposed within a same channel and are operable to receive and store a first vinyl roll and a second vinyl roll wherein the first vinyl roll and the second vinyl roll are oriented in a vertically stacked orientation such that the first vinyl roll and second vinyl roll are in axial alignment.

16. The vinyl roll storage and dispensing apparatus as recited in claim 15, wherein said plurality of vinyl roll engagement members further include an upper mounting disc and a lower mounting disc rotatably secured to said support arm distal to said base.

17. The vinyl roll storage and dispensing apparatus as recited in claim 16, wherein said second support member further includes a perimeter edge, said perimeter edge being undulated in form, wherein the undulated form of the perimeter edge is configured to form projection areas.

18. The vinyl roll storage and dispensing apparatus as recited in claim 17, wherein said plurality of roll mounts and said plurality of vinyl roll engagement members are in axial alignment along a common channel.

19. The vinyl roll storage and dispensing apparatus as recited in claim 18, wherein said plurality of vinyl roll engagement members further include at least one keeper, said at least one keeper operable to maintain a position of the vinyl roll engagement members within said plurality of channels.

20. The vinyl roll storage and dispensing apparatus as recited in claim 19, wherein said upper mounting disc and said lower mounting disc are half-domed shaped having a flat upper surface.

* * * * *